US011181087B1

(12) United States Patent
Kucukarslan et al.

(10) Patent No.: US 11,181,087 B1
(45) Date of Patent: Nov. 23, 2021

(54) METHODS AND SYSTEM FOR DETECTING LATENT DEGRADATION OF ENGINE STARTING SYSTEM FEEDBACK

(71) Applicant: Ford Global Technologies, LLC, Dearborn, MI (US)

(72) Inventors: Davud Kucukarslan, Madison Heights, MI (US); Eric Luehrsen, Dearborn, MI (US); Alex Gibson, Ann Arbor, MI (US); Vito Trupiano, Brownstown, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/868,757

(22) Filed: May 7, 2020

(51) Int. Cl.
*F02N 11/10* (2006.01)
*F02N 11/08* (2006.01)

(52) U.S. Cl.
CPC ..... *F02N 11/108* (2013.01); *F02N 11/0825* (2013.01); *F02N 11/101* (2013.01); *F02N 11/0862* (2013.01); *F02N 2011/0896* (2013.01)

(58) Field of Classification Search
CPC .. F02N 11/108; F02N 11/101; F02N 11/0825; F02N 2011/0896; F02N 11/0862
See application file for complete search history.

(56) References Cited

U.S. PATENT DOCUMENTS

| | | | | |
|---|---|---|---|---|
| 10,029,695 | B1 * | 7/2018 | Gibson | B60W 10/08 |
| 2009/0315410 | A1 * | 12/2009 | Tyrrell | H03K 5/1254 307/135 |
| 2011/0106415 | A1 * | 5/2011 | Guido | F02D 41/28 701/115 |
| 2014/0041484 | A1 | 2/2014 | Park et al. | |
| 2014/0191513 | A1 * | 7/2014 | Kees | F02N 11/006 290/38 R |
| 2014/0251271 | A1 * | 9/2014 | Straka | F02P 11/025 123/406.12 |
| 2017/0096958 | A1 | 4/2017 | Jiang et al. | |
| 2018/0244263 | A1 * | 8/2018 | Bower | B60W 10/02 |

* cited by examiner

*Primary Examiner* — Xiao En Mo

(74) *Attorney, Agent, or Firm* — Geoffrey Brumbaugh McCoy Russell LLP

(57) ABSTRACT

A method and system for operating a vehicle that includes feedback of operating status of an engine starting system is described. In one example, the method inhibits automatic engine pull-down in response to feedback from an engine starting system that does not meet expectations. The system and method may provide diagnostics for the engine starting system.

20 Claims, 5 Drawing Sheets

METHODS AND SYSTEM FOR DETECTING LATENT DEGRADATION OF ENGINE STARTING SYSTEM FEEDBACK

FIELD

The present description relates to methods and a system for determining latent degradation of engine starting system feedback. The methods and systems may be suitable for vehicles that include starting devices having one or more feedback indicators.

BACKGROUND AND SUMMARY

An engine of a vehicle may include a starter to rotate an engine before the engine is started. The starter may include a pinion to selectively engage a flywheel of an engine so that the engine may be rotated. In addition, or alternatively, the vehicle may include an integrated starter/generator (ISG) and/or a belt integrated starter/generator (BISG) to crank and rotate the engine before the engine is started. It may be desirable to provide on-board diagnostics to indicate the presence or absence of engine starting system degradation (e.g., lower than desired engine cranking speed provided via engine starting system, high or low electric current consumption, etc.) so that a vehicle operator or autonomous driver may seek service for the vehicle. However, it may be desirable to provide diagnostics that are more sophisticated than diagnostics that simply indicate whether or not the engine was cranked successfully.

The inventors herein have recognized the above-mentioned issues and have developed a method for diagnosing operation of an engine starting system, comprising: sampling an engine starting system feedback signal and storing a sampled engine starting system feedback signal to memory via a controller in response to an engine start request and an engine speed being greater than a first threshold speed; ceasing sampling the engine starting system feedback signal via the controller in response to the engine speed being greater than a second threshold speed; and indicating engine starting system degradation in response to the sampled engine starting system feedback signal not conforming to an expected engine starting system feedback signal.

By storing engine starting system feedback signals during engine starting, it may be possible to provide diagnostics for an engine starting system that go beyond simply indicating whether or not an engine started. For example, evaluation of engine starting system feedback during engine cranking may provide insight into operation and performance of individual engine starting system components so that degraded system components may be determined more efficiently. In addition, portions of an engine starting system that are operated for a short time and that may not be evaluated after operation may be diagnosed to improve detection of latent issues.

The present description may provide several advantages. Specifically, the approach may improve detection of latent engine starting system issues. Further, the approach may provide an improved way to operate an engine system that includes two or more engine starting system. In addition, the approach may improve operation of automatic engine stopping and starting systems.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
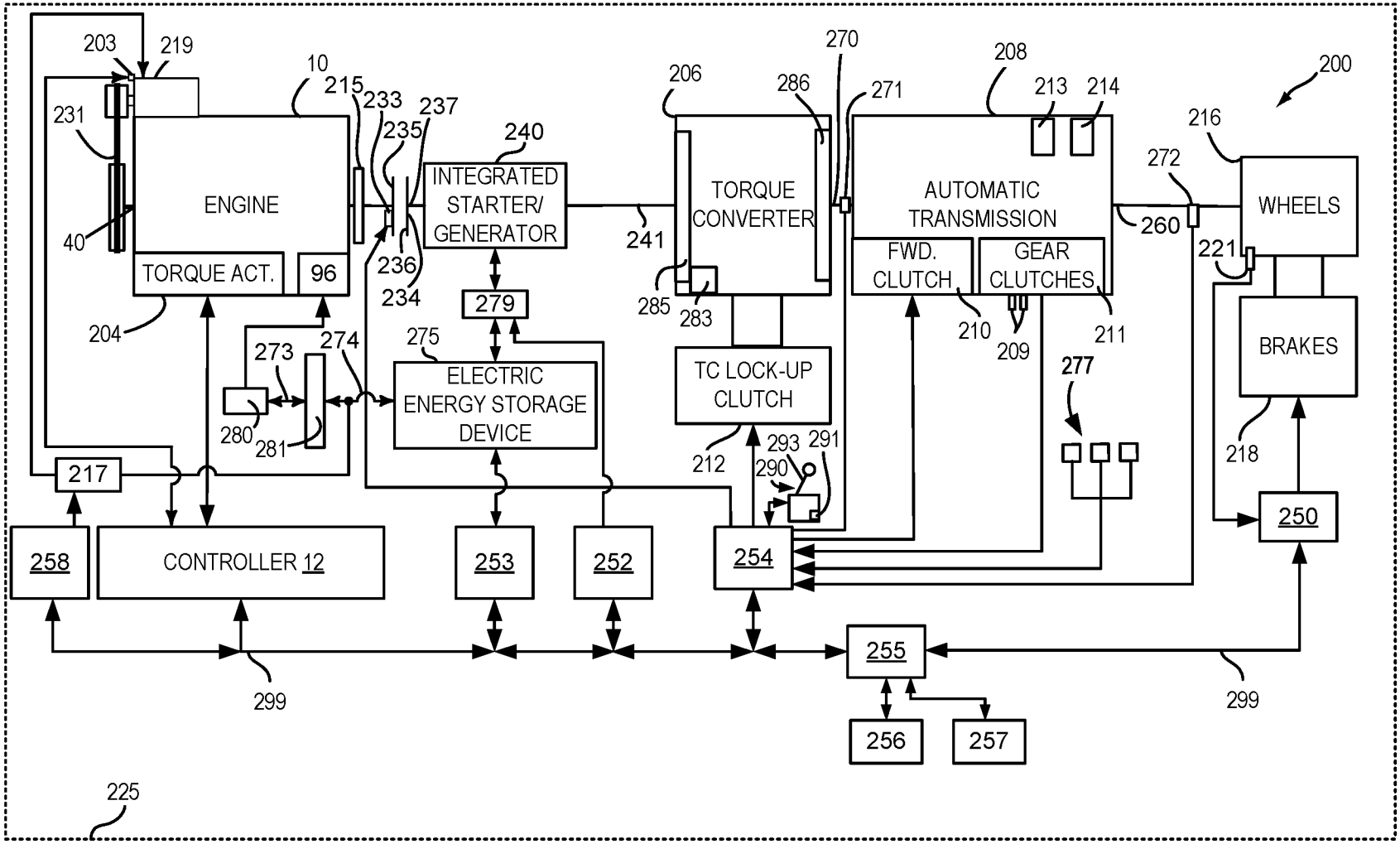
FIG. 2 shows a schematic diagram of an example vehicle driveline or powertrain including the internal combustion engine shown in FIG. 1.
Figure 3:
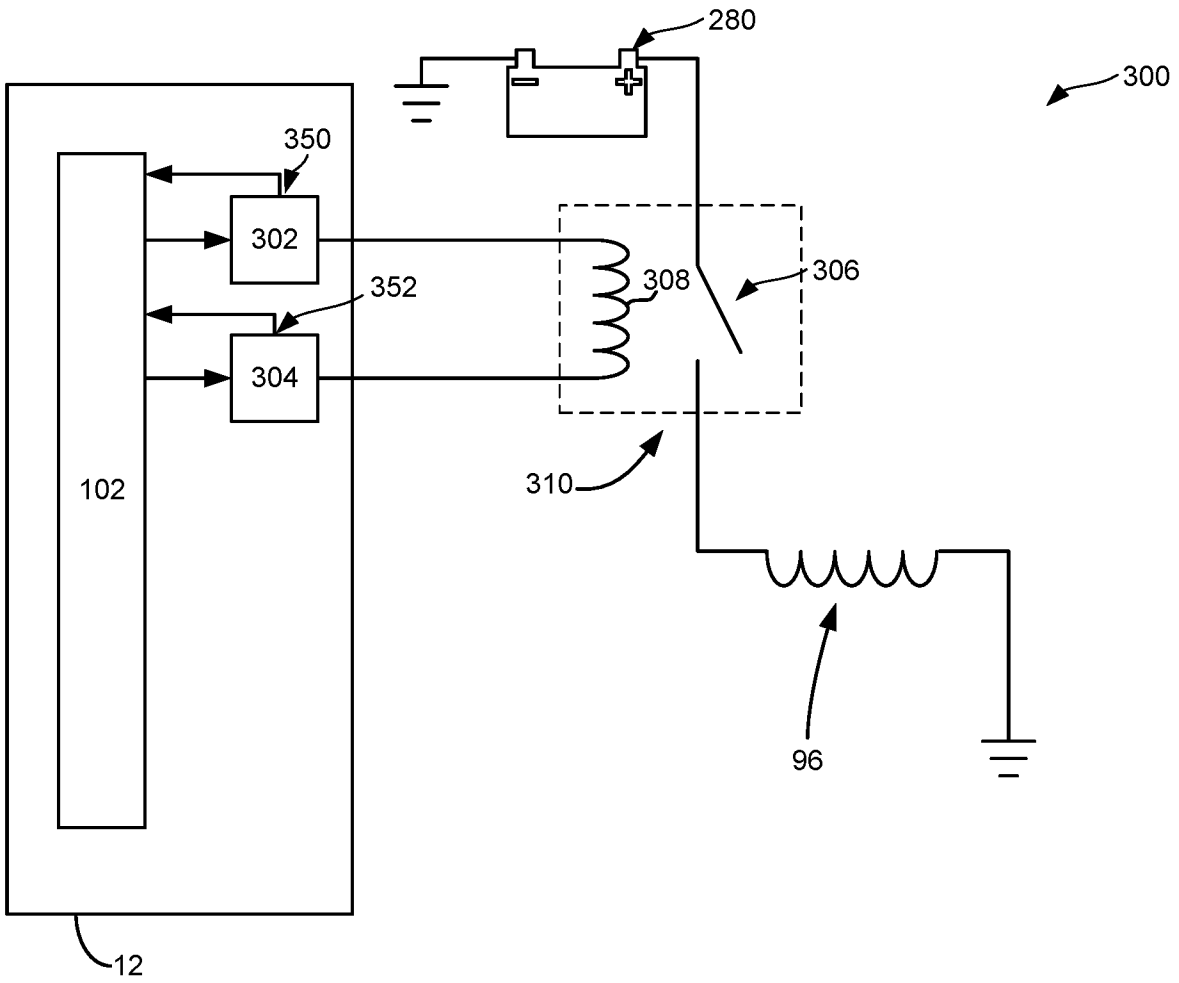
FIG. 3 shows an example schematic of an engine starter relay circuit.
Figure 4:
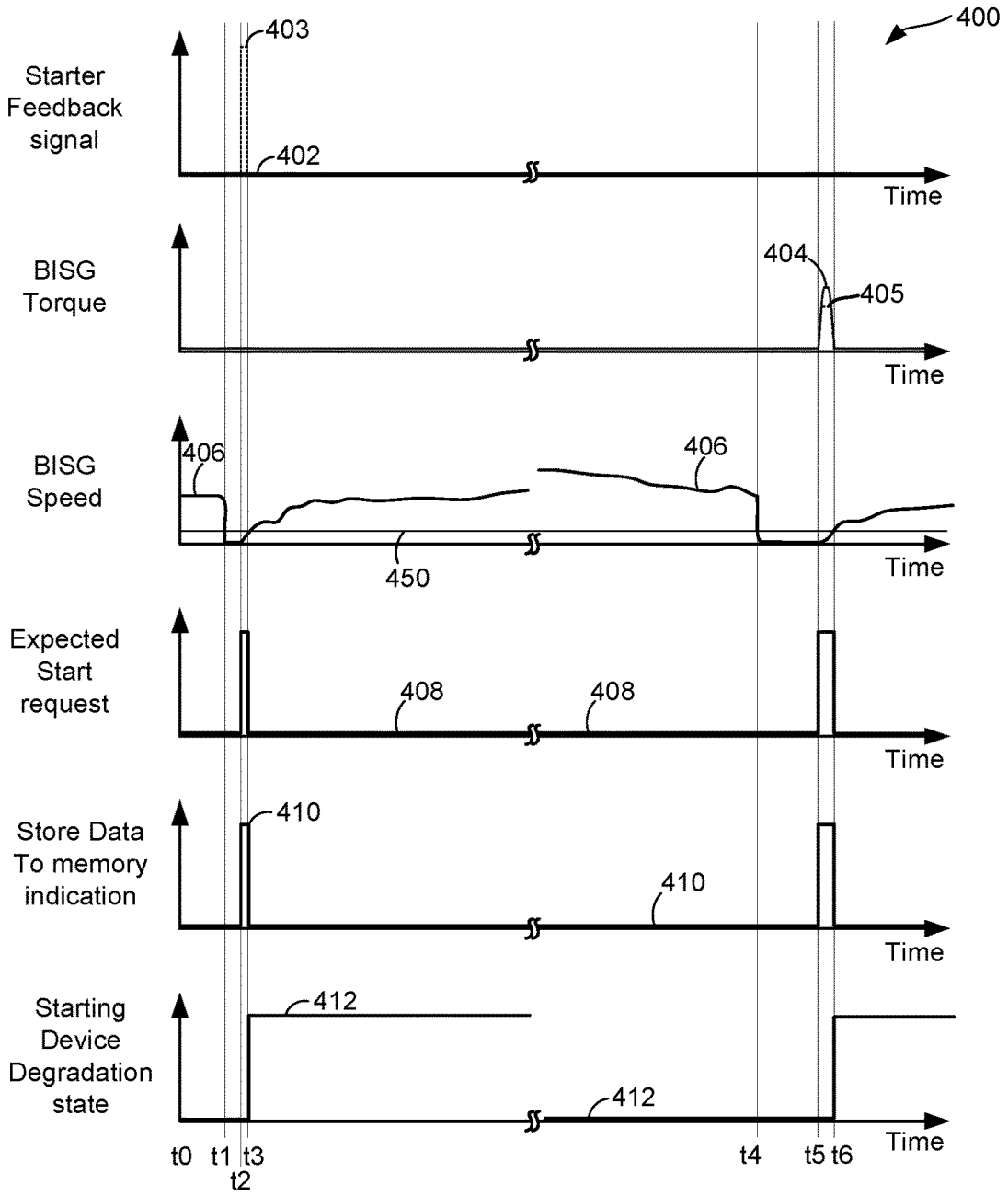
FIG. 4 shows example engine stopping and starting sequences according to the method of FIG. 5.
Figure 5:
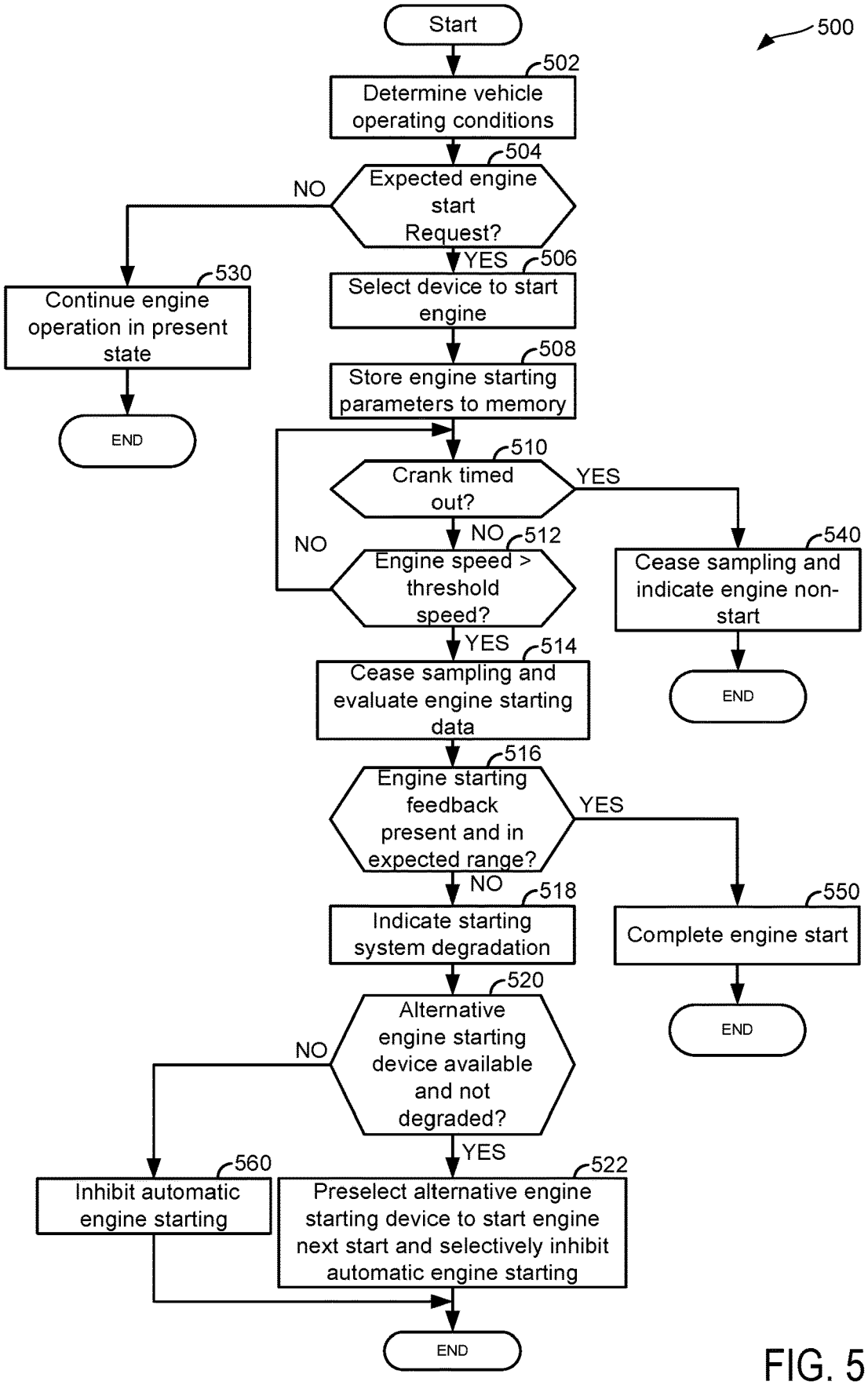
FIG. 5 shows an example method for operating a vehicle and diagnosing engine starting systems.

The present description is related to controlling inhibiting of engine pull-down based on feedback generated from one or more engine starting systems. The inhibiting of engine pull-down may be applied to an engine of the type shown in FIG. 1. The engine may be included in a driveline as shown in FIG. 2. The driveline may include more than one engine starting device. In one example, a conventional starter and a belt integrated starter/generator (BISG) are included in a driveline for starting an engine. FIG. 3 shows detailed components of one engine starting system. Example engine starting sequences according to the method of FIG. 5 are shown in FIG. 4. A method for operating a vehicle and diagnosing engine starting systems is shown in FIG. 5.

Figure 1:
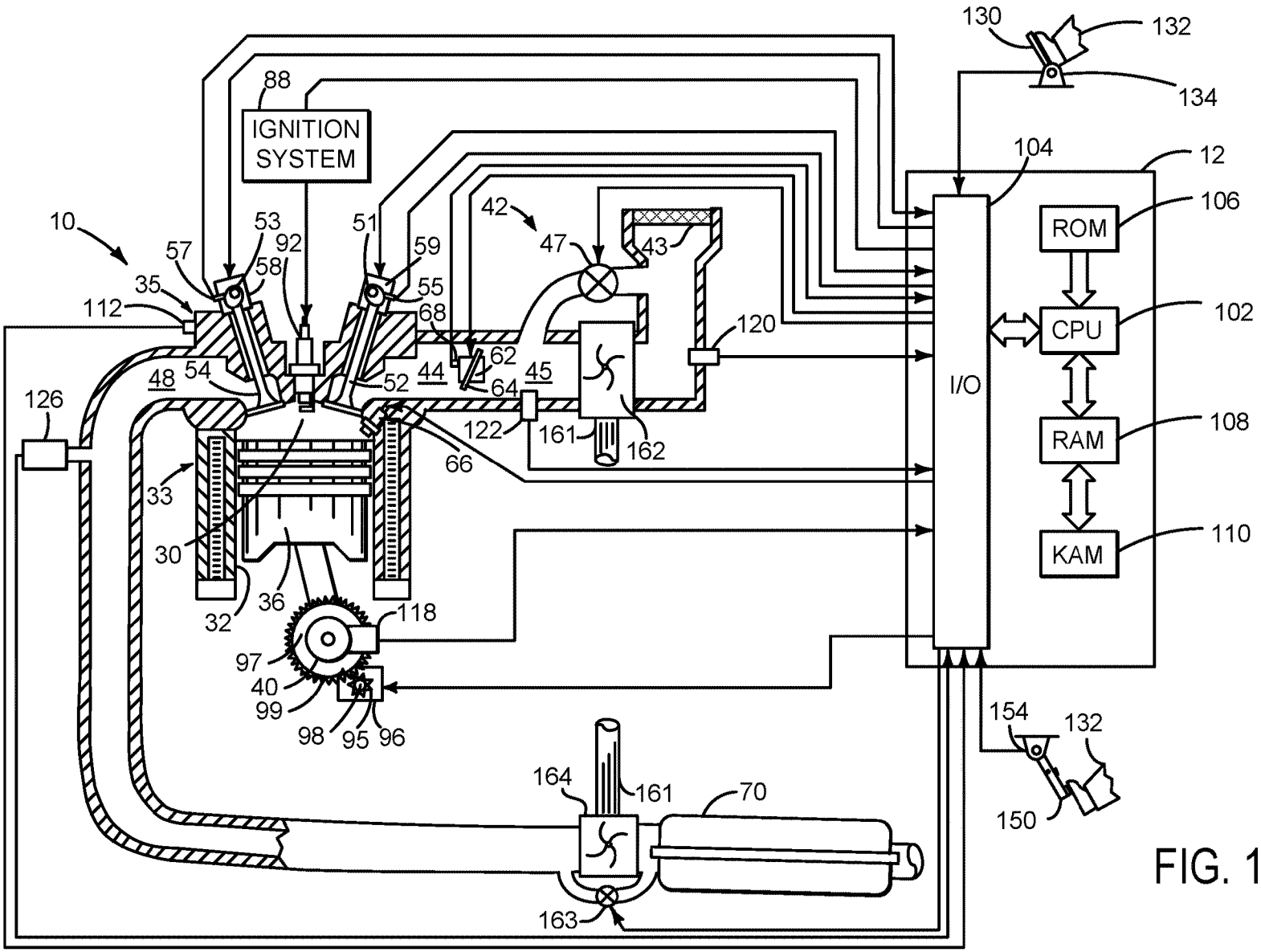
FIG. 1 shows a schematic diagram of an internal combustion engine.

Referring to FIG. 1, internal combustion engine 10, comprising a plurality of cylinders, one cylinder of which is shown in FIG. 1, is controlled by electronic engine controller 12. Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Starter 96 (e.g., low voltage (operated with less than 20 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft.

Combustion chamber 30 is shown communicating with intake manifold 44 and exhaust manifold 48 via respective intake poppet valve 52 and exhaust poppet valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. A lift amount and/or a phase or position of intake valve 52 may be adjusted relative to a position of crankshaft 40 via valve adjustment device 59. A lift amount and/or a phase or position of exhaust valve 54 may be adjusted relative to a position of crankshaft 40 via valve adjustment device 58. Valve adjustment devices 58 and 59 may be electro-mechanical devices, hydraulic devices, or mechanical devices.

Fuel injector 66 is shown positioned to inject fuel directly into cylinder 30, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown). In one example, a high pressure, dual stage, fuel system may be used to generate higher fuel pressures.

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104 (e.g., including analog to digital converters, digital inputs, digital outputs, pulse width outputs, radio frequency inputs, radio frequency outputs, etc.), read-only memory 106 (e.g., non-transitory memory), random access memory 108, keep alive memory 110, and a conventional data bus. Controller 12 is shown receiving various signals from sensors coupled to engine 10, in addition to those signals previously discussed, including: cylinder head temperature from temperature sensor 112 coupled to cylinder head 35; a position sensor 134 coupled to an propulsion pedal 130 for sensing force applied by human foot 132; a position sensor 154 coupled to brake pedal 150 for sensing force applied by foot 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 is a block diagram of a vehicle 225 including a powertrain or driveline 200. The powertrain of FIG. 2 includes engine 10 shown in FIG. 1. Powertrain 200 is shown including vehicle system controller 255, engine controller 12, electric machine controller 252, transmission controller 254, BISG controller 258, energy storage device controller 253, and brake controller 250. The controllers may communicate over controller area network (CAN) 299. Each of the controllers may provide information to other controllers such as power output limits (e.g., power output of the device or component being controlled not to be exceeded), power input limits (e.g., power input of the device or component being controlled not to be exceeded), power output of the device being controlled, sensor and actuator data, diagnostic information (e.g., information regarding a degraded transmission, information regarding a degraded engine, information regarding a degraded electric machine, information regarding degraded brakes). Further, the vehicle system controller 255 may provide commands to engine controller 12, electric machine controller 252, BISG controller 258, transmission controller 254, and brake controller 250 to achieve driver input requests and other requests that are based on vehicle operating conditions.

For example, in response to a driver releasing a propulsion pedal and vehicle speed, vehicle system controller 255 may request a desired wheel power or a wheel power level to provide a desired rate of vehicle speed change. The requested desired wheel power may be provided by vehicle system controller 255 requesting a first braking power from electric machine controller 252 and a second braking power from engine controller 12, the first and second powers providing a desired driveline braking power at vehicle wheels 216. Vehicle system controller 255 may also request a friction braking power via brake controller 250. The braking powers may be referred to as negative powers since they slow driveline and wheel rotation. Positive power may maintain or increase speed of the driveline and wheel rotation.

In response to an engine starting request, BISG controller 258 may rotate command BISG 219 to rotate and start engine 10. Likewise, electric machine controller 252 may rotate ISG 240 to rotate and start engine 10 while disconnect clutch 236 is closed. In addition, BISG controller 258 and electric machine controller 252 may output torque and speed of BISG 219 and ISG 240 to CAN 299 to be received by one or more of the other previously mentioned controllers during engine starting to provide feedback as to the operating states of these engine starting systems.

Vehicle controller 255 and/or engine controller 12 may also receive input from human/machine interface 256 and traffic conditions (e.g., traffic signal status, distance to objects, etc.) from sensors 257 (e.g., cameras, LIDAR, RADAR, etc.). In one example, human/machine interface 256 may be a touch input display panel. Alternatively, human/machine interface 256 may be a key switch or other known type of human/machine interface. Human/machine interface 256 may receive requests from a user. For example, a user may request an engine stop or start via human/machine interface 256. Additionally, human/machine interface 256 may display status messages and engine data that may be received from controller 255.

In other examples, the partitioning of controlling powertrain devices may be partitioned differently than is shown in FIG. 2. For example, a single controller may take the place of vehicle system controller 255, engine controller 12, electric machine controller 252, transmission controller 254, and brake controller 250. Alternatively, the vehicle system controller 255 and the engine controller 12 may be a single unit while the electric machine controller 252, the transmission controller 254, and the brake controller 250 are standalone controllers.

In this example, powertrain 200 may be powered by engine 10 and electric machine 240 (e.g., ISG). In other examples, engine 10 may be omitted. Engine 10 may be started with an engine starting system shown in FIG. 1, via belt integrated starter/generator BISG 219, or via driveline integrated starter/generator (ISG) 240 also known as an integrated starter/generator. A temperature of BISG windings may be determined via BISG winding temperature sensor 203. Driveline ISG 240 (e.g., high voltage (operated with greater than 30 volts) electrical machine) may also be referred to as an electric machine, motor, and/or generator. Further, power of engine 10 may be adjusted via torque actuator 204, such as a fuel injector, throttle, etc.

BISG 219 is mechanically coupled to engine 10 via belt 231 and BISG 219 may be referred to as an electric machine, motor, or generator. BISG 219 may be coupled to crankshaft 40 or a camshaft (e.g., 51 or 53 of FIG. 1). BISG 219 may operate as a motor when supplied with electrical power via high voltage bus 274 via inverter 217. Inverter 217 converts direct current (DC) power from high voltage bus 274 to alternating current (AC) and vice-versa so that power may be exchanged between BISG 219 and electric energy storage device 275. Thus, BISG 219 may operate as a generator supplying electrical power to high voltage electric energy storage device (e.g., battery) 275 and/or low voltage bus 273. Bi-directional DC/DC converter 281 may transfer electrical energy from a high voltage buss 274 to a low voltage bus 273 or vice-versa. Low voltage battery 280 is electrically directly coupled to low voltage bus 273. Low voltage bus 273 may be comprised of one or more electrical conductors. Electric energy storage device 275 is electrically coupled to high voltage bus 274. Low voltage battery 280 may selectively supply electrical energy to starter motor 96.

An engine output power may be transmitted to a first or upstream side of powertrain disconnect clutch 235 through dual mass flywheel 215. Disconnect clutch 236 is hydraulically actuated and hydraulic pressure within driveline disconnect clutch 236 (driveline disconnect clutch pressure) may be adjusted via electrically operated valve 233. The downstream or second side 234 of disconnect clutch 236 is shown mechanically coupled to ISG input shaft 237.

ISG 240 may be operated to provide power to powertrain 200 or to convert powertrain power into electrical energy to be stored in electric energy storage device 275 in a regeneration mode. ISG 240 is in electrical communication with energy storage device 275 via inverter 279. Inverter 279 may convert direct current (DC) electric power from electric energy storage device 275 into alternating current (AC) electric power for operating ISG 240. Alternatively, inverter 279 may convert AC power from ISG 240 into DC power for storing in electric energy storage device 275. Inverter 279 may be controlled via electric machine controller 252. ISG 240 has a higher output power capacity than starter 96 shown in FIG. 1 or BISG 219. Further, ISG 240 directly drives powertrain 200 or is directly driven by powertrain 200. There are no belts, gears, or chains to couple ISG 240 to powertrain 200. Rather, ISG 240 rotates at the same rate as powertrain 200. Electrical energy storage device 275 (e.g., high voltage battery or power source) may be a battery, capacitor, or inductor. The downstream side of ISG 240 is mechanically coupled to the impeller 285 of torque converter 206 via shaft 241. The upstream side of the ISG 240 is mechanically coupled to the disconnect clutch 236. ISG 240 may provide a positive power or a negative power to powertrain 200 via operating as a motor or generator as instructed by electric machine controller 252.

Torque converter 206 includes a turbine 286 to output power to input shaft 270. Input shaft 270 mechanically couples torque converter 206 to automatic transmission 208. Torque converter 206 also includes a torque converter bypass lock-up clutch 212 (TCC). Power is directly transferred from impeller 285 to turbine 286 when TCC 212 is locked. TCC 212 is electrically operated by controller 254. Alternatively, TCC may be hydraulically locked. In one example, the torque converter 206 may be referred to as a component of the transmission.

When torque converter lock-up clutch 212 is fully disengaged, torque converter 206 transmits engine power to automatic transmission 208 via fluid transfer between the torque converter turbine 286 and torque converter impeller 285, thereby enabling torque multiplication. In contrast, when torque converter lock-up clutch 212 is fully engaged, the engine output power is directly transferred via the torque converter clutch to an input shaft 270 of transmission 208. Alternatively, the torque converter lock-up clutch 212 may be partially engaged, thereby enabling the amount of power that is directly delivered to the transmission to be adjusted. The transmission controller 254 may be configured to adjust the amount of power transmitted by torque converter 212 by adjusting the torque converter lock-up clutch in response to various engine operating conditions, or based on a driver-based engine operation request.

Torque converter 206 also includes pump 283 that pressurizes fluid to operate disconnect clutch 236, forward clutch 210, and gear clutches 211. Pump 283 is driven via impeller 285, which rotates at a same speed as ISG 240.

Automatic transmission 208 includes gear clutches 211 and forward clutch 210 for selectively engaging and disengaging forward gears 213 (e.g., gears 1-10) and reverse gear 214. Automatic transmission 208 is a fixed ratio transmission. Alternatively, transmission 208 may be a continuously variable transmission that has a capability of simulating a fixed gear ratio transmission and fixed gear ratios. The gear clutches 211 and the forward clutch 210 may be selectively engaged to change a ratio of an actual total number of turns of input shaft 270 to an actual total number of turns of wheels 216. Gear clutches 211 may be engaged or disengaged via adjusting fluid supplied to the clutches via shift control solenoid valves 209. Power output from the automatic transmission 208 may also be transferred to wheels 216 to propel the vehicle via output shaft 260. Specifically, automatic transmission 208 may transfer an input driving power at the input shaft 270 responsive to a vehicle traveling condition before transmitting an output driving power to the wheels 216. Transmission controller 254 selectively activates or engages TCC 212, gear clutches 211, and forward clutch 210. Transmission controller also selectively deactivates or disengages TCC 212, gear clutches 211, and forward clutch 210.

Further, a frictional force may be applied to wheels 216 by engaging friction wheel brakes 218. In one example, friction wheel brakes 218 may be engaged in response to a human driver pressing their foot on a brake pedal (not shown) and/or in response to instructions within brake controller 250. Further, brake controller 250 may apply brakes 218 in response to information and/or requests made by vehicle system controller 255. In the same way, a frictional force may be reduced to wheels 216 by disengaging wheel brakes 218 in response to the human driver releasing their foot from a brake pedal, brake controller instructions, and/or vehicle system controller instructions and/or information.

In response to a request to increase speed of vehicle 225, vehicle system controller may obtain a driver demand power or power request from an propulsion pedal or other device. Vehicle system controller 255 then allocates a fraction of the requested driver demand power to the engine and the remaining fraction to the ISG or BISG. Vehicle system controller 255 requests the engine power from engine controller 12 and the ISG power from electric machine controller 252. If the ISG power plus the engine power is less than a transmission input power limit (e.g., a threshold value not to be exceeded), the power is delivered to torque converter 206 which then relays at least a fraction of the requested power to transmission input shaft 270. Transmission controller 254 selectively locks torque converter clutch 212 and engages gears via gear clutches 211 in response to shift schedules and TCC lockup schedules that may be based on input shaft power and vehicle speed. In some conditions when it may be desired to charge electric energy storage device 275, a charging power (e.g., a negative ISG power) may be requested while a non-zero driver demand power is present. Vehicle system controller 255 may request increased engine power to overcome the charging power to meet the driver demand power.

Accordingly, power control of the various powertrain components may be supervised by vehicle system controller 255 with local power control for the engine 10, transmission 208, electric machine 240, and brakes 218 provided via engine controller 12, electric machine controller 252, transmission controller 254, and brake controller 250.

As one example, an engine power output may be controlled by adjusting a combination of spark timing, fuel pulse width, fuel pulse timing, and/or air charge, by controlling throttle opening and/or valve timing, valve lift and boost for turbo- or super-charged engines. In the case of a diesel engine, controller 12 may control the engine power output by controlling a combination of fuel pulse width, fuel pulse timing, and air charge. Engine braking power or negative engine power may be provided by rotating the engine with the engine generating power that is insufficient to rotate the engine. Thus, the engine may generate a braking power via operating at a low power while combusting fuel, with one or more cylinders deactivated (e.g., not combusting fuel), or with all cylinders deactivated and while rotating the engine. The amount of engine braking power may be adjusted via adjusting engine valve timing. Engine valve timing may be adjusted to increase or decrease engine compression work. Further, engine valve timing may be adjusted to increase or decrease engine expansion work. In all cases, engine control may be performed on a cylinder-by-cylinder basis to control the engine power output.

Electric machine controller 252 may control power output and electrical energy production from ISG 240 by adjusting current flowing to and from field and/or armature windings of ISG 240 as is known in the art.

Transmission controller 254 receives transmission input shaft position via position sensor 271. Transmission controller 254 may convert transmission input shaft position into input shaft speed via differentiating a signal from position sensor 271 or counting a number of known angular distance pulses over a predetermined time interval. Transmission controller 254 may receive transmission output shaft torque from torque sensor 272. Alternatively, sensor 272 may be a position sensor or torque and position sensors. If sensor 272 is a position sensor, controller 254 may count shaft position pulses over a predetermined time interval to determine transmission output shaft velocity. Transmission controller 254 may also differentiate transmission output shaft velocity to determine transmission output shaft speed change. Transmission controller 254, engine controller 12, and vehicle system controller 255, may also receive addition transmission information from sensors 277, which may include but are not limited to pump output line pressure sensors, transmission hydraulic pressure sensors (e.g., gear clutch fluid pressure sensors), ISG temperature sensors, and BISG temperatures, gear shift lever sensors, and ambient temperature sensors. Transmission controller 254 may also receive requested gear input from gear shift selector 290 (e.g., a human/machine interface device). Gear shift selector 290 may include positions for gears 1-X (where X is an upper gear number), D (drive), neutral (N), and P (park). Shift selector 290 shift lever 293 may be prevented from moving via a solenoid actuator 291 that selectively prevents shift lever 293 from moving from park or neutral into reverse or a forward gear position (e.g., drive).

Brake controller 250 receives wheel speed information via wheel speed sensor 221 and braking requests from vehicle system controller 255. Brake controller 250 may also receive brake pedal position information from brake pedal sensor 154 shown in FIG. 1 directly or over CAN 299. Brake controller 250 may provide braking responsive to a wheel power command from vehicle system controller 255. Brake controller 250 may also provide anti-lock and vehicle stability braking to improve vehicle braking and stability. As such, brake controller 250 may provide a wheel power limit (e.g., a threshold negative wheel power not to be exceeded) to the vehicle system controller 255 so that negative ISG power does not cause the wheel power limit to be exceeded. For example, if controller 250 issues a negative wheel torque limit of 50 N-m, ISG power is adjusted to provide less than 50 N-m (e.g., 49 N-m) of negative torque at the wheels, including compensating for transmission gearing.

Referring now to FIG. 3, a detailed schematic of a first engine starting system 300 that includes starter 96 of FIG. 1 is shown. Controller 12 is configured to activate and deactivate engine starter 96. In particular, controller 12 includes CPU 102 which may operate (e.g., open and close) drivers 302 and 304 (e.g., field effect transistors, bipolar transistors, etc.). In turn, drivers 302 and 304 may close to allow electric current to flow through coil 308 of starter relay 310. Driver 302 is a high side driver that may selectively be closed to supply electric power to coil 308. Driver 302 provides feedback at output 350 which indicates the operating state of driver 302. The feedback from output 350 is input to CPU 102. Similarly, driver 304 is a low side driver that may be selectively closed to couple coil 308 to ground or a lower potential. Driver 304 provides feedback at output 352 which indicates the operating state of driver 304. The feedback at output 352 is input to CPU 102. Coil 308 may be energized when drivers 302 and 304 are closed, thereby causing switch 306 to close. Closing switch 306 allows electric power to flow from low voltage battery 280 to starter 96. Starter 96 may rotate engine 10 when electric power is supplied to starter 96.

Drivers 302 and 304 may provide a first predetermined voltage (e.g., 5 volts) output when closed. Drivers 302 and 304 may provide a second predetermined voltage (e.g., less than 0.7 volts) when open. Drivers 302 and 304 may provide the second predetermined voltage when they have not received a command to close or when they have been commanded to close but do not close. Thus, drivers 302 and 304 provide feedback of their respective operating states via outputs 350 and 352.

Thus, the system of FIGS. 1-3 provide for a vehicle system, comprising: an internal combustion engine; a starting system for the internal combustion engine comprising an electric machine and at least one feedback signal indicating operating status of the starting system; and a controller including executable instructions stored in non-transitory memory that cause the controller to inhibit automatic stopping of the internal combustion engine in response to the at least one feedback signal. The vehicle system includes where the at least one feedback signal indicates status of a driver circuit. The vehicle system includes where the driver circuit includes a field effect transistor or a bipolar transistor. The vehicle system includes where the at least one feedback signal indicates torque output of the starting system. The vehicle system further comprises a second starting system for the internal combustion engine comprising a second electric machine and at least one feedback signal indicating operating status of the second starting system. The vehicle system further comprises additional instructions to inhibit operation of the starting system in response to the at least one feedback signal indicating operating status of the starting system. The vehicle system further comprises additional instructions to inhibit operation of the second starting system in response to the at least one feedback signal indicating operating status of the second starting system. The vehicle system further comprises additional instructions to inhibit automatic stopping of the internal combustion engine in response to the at least one feedback signal indicating operating status of the second starting system.

Referring now to FIG. 4, an example vehicle operating sequence is shown. The sequence of FIG. 4 may be generated via the system of FIGS. 1-3 in cooperation with the method of FIG. 5. Vertical lines at times t0-t6 represent times of interest during the sequence. The plots in FIG. 4 are time aligned and occur at the same time. The SS marks along each of the horizontal axes represent breaks in time that may be short or long in duration.

The first plot from the top of FIG. 4 is a plot of a starter feedback signal (e.g., feedback output 350 or 352 of drivers 302 and 304) versus time. The vertical axis represents the starter feedback signal level and the starter feedback signal is a high level near the vertical axis arrow when the starter is actually on (e.g., rotating the engine). The starter feedback signal level is a lower level near the horizontal axis when the starter is actually off (e.g., not rotating the engine). The horizontal axis represents time and the amount of time increases from the left side of the plot to the right side of the plot. Solid line trace 402 represents the actual starter feedback signal and dashed line trace 403 represents the expected starter feedback signal. The expected starter feedback signal is equal to the actual starter feedback signal when only the actual starter feedback signal is visible.

The second plot from the top of FIG. 4 is a plot of BISG torque output (e.g., torque output from BISG 219) versus time. The vertical axis represents the BISG output torque and the BISG output torque amount increases in the direction of the vertical axis arrow. The horizontal axis represents time and the amount of time increases from the left side of the plot to the right side of the plot. Solid line trace 404 represents the actual BISG output torque and dashed line trace 405 represents the expected BISG output torque signal. The expected BISG torque signal is equal to the actual BISG torque signal when only the actual BISG torque signal is visible.

The third plot from the top of FIG. 4 is a plot of BISG speed output (e.g., speed of BISG 219) versus time. The vertical axis represents the BISG output speed and the BISG output speed amount increases in the direction of the vertical axis arrow. The horizontal axis represents time and the amount of time increases from the left side of the plot to the right side of the plot. Trace 406 represents the actual BISG output speed. Line 450 represents a second threshold speed above which engine starting data is not stored to controller memory.

The fourth plot from the top of FIG. 4 is a plot of an expected engine start request versus time. The vertical axis represents the level of the expected engine start request and the engine start request is asserted when trace 408 is at a higher level near the vertical axis arrow. The expected engine start request is not asserted when trace 408 is at a lower level near the horizontal axis. Trace 408 represents the expected engine start signal level. The horizontal axis represents time and time increases from the left side of the plot to the right side of the plot.

The fifth plot from the top of FIG. 4 is a plot of a request to store engine starting system data to controller memory (e.g., RAM 108) versus time. The vertical axis represents the level of the request to store engine starting system data to memory and the request to store engine starting system data to controller memory is asserted when trace 410 is at a higher level near the vertical axis arrow. The request to store engine starting system data to controller memory is not asserted when trace 410 is at a lower level near the horizontal axis. Trace 410 represents the request to store engine starting system data to controller memory. The horizontal axis represents time and time increases from the left side of the plot to the right side of the plot.

The sixth plot from the top of FIG. 4 is a plot of engine starting device degradation state versus time. The vertical axis represents the engine starting device degradation state and the engine starting device degradation state is asserted when trace 412 is at a higher level near the vertical axis arrow. The engine starting device degradation state is not asserted when trace 412 is at a lower level near the horizontal axis. Trace 412 represents the engine starting device degradation state. The horizontal axis represents time and time increases from the left side of the plot to the right side of the plot.

At time t0, the engine is running and the vehicle is moving (not shown). The starter feedback signal is at a lower level as is the expected starter feedback signal. The BISG torque is zero and the expected BISG torque is zero. The BISG speed is at a middle level and the expected engine start request is not asserted. The store engine starting data to memory is not asserted and the engine starting device degradation state is not asserted.

At time t1, the engine is commanded to stop and so the BISG speed begins to be reduced to zero. The BISG torque is zero and the starter feedback signal remains at a lower level. The expected engine start request is not asserted and the store engine data to memory is not asserted. The starting device degradation state is not asserted.

At time t2, the expected engine start request is asserted and the store engine starting data to memory state is asserted shortly thereafter in response to engine speed being greater than a first threshold speed. The engine starter (not shown) is commanded to rotate the engine in response to the expected engine start request being asserted. However, in this example, the starter feedback signal 402 remains low and the expected starter feedback signal 403 is high. The starter feedback signal 402 may remain low if the driver circuit feedback output does not respond when the driver circuit supplies electric power to the starter relay (not shown). Further, the starter feedback signal may remain low if the driver circuit does not supply electric power to the starter relay as commanded. In this example, the driver circuit feedback output does respond to the driver supplying electric power to the starter relay. Nevertheless, the starter engages the engine and the engine starts as indicated by the increasing BISG speed. The BISG torque is zero since the BISG is not used to start the engine. Engine starting device degradation is not asserted.

At time t3, the engine speed exceeds a second threshold speed 450. Therefore, storing engine starting data to controller memory ceases. In addition, it is recognized shortly after time t3 that the engine starter feedback signal is not equivalent or near the expected engine starter feedback signal. Therefore, the engine starting device degradation state is asserted. The BISG torque remains zero and BISG speed follows engine speed. The expected engine start request is withdrawn after engine speed exceeds the second threshold speed 450. Automatic engine stopping or automatic engine pull-down may not be permitted when the engine starting device degradation state is asserted.

A break in the engine operating sequence occurs between time t3 and time t4. Shortly before time t4, the engine is running (not shown) and the BISG is at a middle speed.

At time t4, the engine is commanded to stop (e.g., cease engine rotation and combustion within the engine). The engine starter feedback signal is not asserted and BISG torque is zero. The expected engine start request is not asserted and storing engine starting data to controller memory is not requested. Additionally, engine starting device degradation state is not asserted. Thus, the engine starter degradation indicated via the engine starting device degradation state indicator has been resolved.

At time t5, the expected engine start request is asserted and the store engine starting data to memory state is asserted shortly thereafter in response to engine speed being greater than a first threshold speed. The engine starter (not shown) is not commanded to rotate the engine in response to the expected engine start request being asserted. Rather, the BISG is commanded to start the engine. Therefore, the actual BISG torque (404) is increased, but the expected BISG torque (405) is much lower than the actual BISG torque. The higher BISG torque may be indicative or the BISG consuming more electric power than expected because of mechanical interference within the BISG or other conditions. The starter feedback signal remains low since the starter is not engaged in this example. The BISG speed begins to increase and engine starting data begins to be stored to controller memory shortly after time t5. Engine starting device degradation is not asserted.

At time t6, the engine speed exceeds a second threshold speed 450. Therefore, storing engine starting data to controller memory ceases. In addition, it is recognized shortly after time t6 that the actual BISG torque is much greater than the expected BISG torque. Therefore, the engine starting device degradation state is asserted. The starter feedback signal remains low and BISG speed follows engine speed. The expected engine start request is withdrawn after engine speed exceeds the second threshold speed 450. Automatic engine stopping or automatic engine pull-down may not be permitted when the engine starting device degradation state is asserted.

In this way, inhibiting of automatic engine pull-down may be performed based on a feedback signal of an engine starting system not conforming to an expected engine starting system feedback signal. Further, the engine starting system feedback signal may be generated via a conventional engine starter, BISG, or ISG.

Referring now to FIG. 5, an example method for operating a vehicle that includes engine starting system feedback is shown. The method of FIG. 5 may be incorporated into and may cooperate with the system of FIGS. 1-3. Further, at least portions of the method of FIG. 5 may be incorporated as executable instructions stored in non-transitory memory while other portions of the method may be performed via a controller transforming operating states of devices and actuators in the physical world.

At 502, method 500 determines vehicle operating conditions. Vehicle operating conditions may include but are not limited to vehicle speed, propulsion pedal position, brake pedal position, state of battery charge, and driver demand torque. Method 500 proceeds to 504.

At 504, method 500 judges if an expected engine start is requested. An expected engine start may include a driver demand initiated engine start including but not limited to key switch and pushbutton initiated engine start requests. Expected engine starts may also include automatic engine starts (e.g., engine starts that are initiated via a controller in response to vehicle operating conditions without human input to a dedicated engine stop/start input device such as a key switch or pushbutton) performed after an engine has stopped rotating for a predetermined amount of time. Change of mind (e.g., where an engine begins to shut-down, but does not stop rotating before the engine is restarted) engine starts and automatic engine starts that occur before an engine has stopped for the predetermined amount of time may not be considered expected engine starts. If method 500 judges that an expected engine start is requested, the answer is yes and method 500 proceeds to 506. Otherwise, the answer is no and method 500 proceeds to 530.

At 530, method 500 continues to operate the engine in its present state and according to engine and vehicle operating conditions. For example, if an engine start is requested and the engine start is not an expected engine start, the engine may be started without storing engine starting data to controller memory. If the engine is running or stopped, the engine may stay in the same state. Method 500 proceeds to exit.

At 506, method 500 selects an engine starting system to start the engine in response to the expected engine start request. Method 500 may select an engine starting system including one of a starter (e.g., 96), a BISG, or ISG to start the engine. The selection may be based on present vehicle operating conditions including ambient temperature, vehicle speed, expected engine NVH (e.g., noise, vibration, and harshness), and availability of engine starting systems. Thus, if an engine starting system is not available due to being inhibited because of lack of engine starting system feedback or starting system degradation, a different engine starting system may be selected. Method 500 selects one of the available engine starting systems to start the engine and begins rotating the engine via the selected engine starting system. If one of the engine starting systems is degraded, method 500 selects an engine starting system that is not degraded to start the engine if a non-degraded engine starting system is available. If all engine starting systems are degraded, then method 500 may select an engine starting system that exhibited degradation of a feedback parameter or value, yet still started the engine. Method 500 proceeds to 508.

At 508, method 500 begins to store engine starting data from the engine starting system to controller memory. In particular, method 500 may begin storing engine starting data including feedback from engine starting systems in response to engine speed being greater than a first threshold speed (e.g., 50 RPM). The feedback may include but is not limited to operating states of driver circuits as described in FIG. 3, starter relay operating state, BISG/ISG torque output, and BISG/ISG speed. Method 500 samples signals representing (e.g., converts into digital values that are stored in controller memory) these states/parameters via an analog to digital converter and/or stores values of variables that may be transmitted via CAN bus and stores the determined values to controller memory. Each time the engine is started, values in controller memory may be over written by new values determined from the most recent engine start. Method 500 proceeds to 510.

At 510, method 500 judges if the engine has been cranked (e.g., rotated via an electric machine) for longer than a threshold amount of time (e.g., 5 seconds). If so, the answer is yes and method 500 proceeds to 540. Otherwise, the answer is no and method 500 proceeds to 512.

At 540, method 500 ceases storing engine starting data to controller memory and indicates that the engine has not started. The indication may be provided via a human/machine interface or to a remote server. Additional engine starting attempts may be generated with human or autonomous driver permission. In some examples, method 500 may also evaluate engine starting data as described further at step 514. Method 500 proceeds to exit.

At 512, method 500 judges if the present engine speed is greater than a second threshold speed (e.g., 450 RPM). If so, the answer is yes and method 500 proceeds to 514. Otherwise, the answer is no and method 500 returns to 510.

At 514, method 500 ceases storing engine starting data to controller memory and evaluates engine starting data. In one example, method 500 determines if actual engine starting variables are within a predetermined range of expected engine starting variables (e.g., within ±10% of expected engine starting variable values). For example, if an engine starting system circuit outputs driver feedback of 5 volts and the expected driver feedback is 4.9 volts, then the actual driver feedback is within the threshold value of 4.9 volts (e.g., 4.9*.1=0.49 (10% of expected value); 4.9+0.49=5.39 (upper bound of expected value); 5 (actual value)<5.39 (threshold)). Therefore, the driver feedback is within the threshold range. In another example, if the engine starting system circuit outputs a driver feedback of 0.8 volts and the expected driver feedback is 4.9 volts, then the actual driver feedback is not within the threshold value of 4.9 volts (e.g., 4.9*.1=0.49 (10% of expected value); 4.9−0.49=4.41 volts (lower bound of expected value); 0.8 (actual value)<4.41 (threshold)). Therefore, the driver feedback is not within the threshold range. In another example, if the expected torque output of the BISG is 60 Newton-meters (Nm) and the BISG outputs an actual value of 80 Nm during engine cranking, then the actual BISG torque feedback is not within an expected range during engine cranking (e.g., 60*.1=6 (10% of expected value); 60+6=66 (upper bound of expected value); 80 (actual value)>66 (threshold)). Thus, method 500 may evaluate actual values against expected values. The expected values may be empirically determined and stored in controller memory. Method 500 proceeds to 516.

At 516, method 500 judges if engine starting feedback variables are within expected ranges. If so, the answer is yes and method 500 proceeds to 550. Otherwise, the answer is no and method 500 proceeds to 518.

At 550, method 500 completes the engine start and the engine accelerates to a commanded speed or it delivers a requested torque. Method 500 proceeds to exit.

At 518, method 500 indicates degradation of one or more engine starting systems. Method 500 may indicate that a driver circuit is not outputting an expected feedback value, a BISG or ISG is not indicating an expected torque output, the BISG or ISG is not at an expected speed, or other another engine starting system variable is not conforming to an expected engine starting system value. The indication may be provided via a human/machine interface or to a remote server. Method 500 proceeds to 520.

At 520, method 500 judges if the engine includes an alternative engine starting system that is available and has not already determined to be in a degraded state. If so, the answer is yes and method 500 proceeds to 522. Otherwise, the answer is no and method 500 proceeds to 560.

For example, if it is determined that a starter (e.g., 96 of FIG. 1) is degraded and the engine includes a BISG (e.g., 219) that is not in a degraded condition, then method 500 proceeds to 522. However, if the BISG is degraded and the starter is degraded, method 500 proceeds to 560.

At 560, method 500 inhibits automatic engine stopping and starting. Thus, the vehicle controller and/or engine controller are not permitted to automatically stop the engine (e.g., stop engine rotation without a human or autonomous driver specifically requesting an engine stop). By preventing automatic engine stopping, the vehicle may have a higher likelihood of reaching its intended destination before the engine is stopped. In addition, preventing automatic engine stopping may reduce the possibility of further degrading one or more engine starting systems. Method 500 proceeds to exit.

At 522, method 500 may preselect an engine starting system for subsequent engine starting requests. For example, if a starter engine starting system (e.g., 96) is degraded, method 500 may pre-select a BISG to start the engine the next time an engine start is requested. In such case, the starter may be characterized as being in degraded condition.

Alternatively, if the BISG 219 or ISG 240 is degraded, method 500 may pre-select the starter (e.g., 96) to start the engine the next time an engine start is requested. Method 500 may also inhibit automatic engine stops and starts based on the engine starting system that is pre-selected for the next engine start. For example, if a starter engine starting system (e.g., 96) is degraded, method 500 may permit automatic engine stopping and starting via a BISG engine starting system if ambient temperature is greater than a threshold temperature the next time automatic engine stopping is considered. However, if a starter engine starting system (e.g., 96) is degraded, method 500 may not permit automatic engine stopping and starting via the BISG engine starting system if ambient temperature is less than a threshold temperature the next time automatic engine stopping is considered. Similarly, if a BISG engine starting system (e.g., 219) is degraded, method 500 may permit automatic engine stopping and starting via the starter engine starting system (e.g., 96) if the starter engine starting system has started the engine less than 85% of the starter engine starting system's useful life engine starts (e.g., less than 85% of 5000 expected engine starts over the life expectancy of engine starts). However, if a BISG engine starting system (e.g., 219) is degraded, method 500 may not permit automatic engine stopping and starting if the starter engine starting system has started the engine more than 85% of the starter engine starting system's useful life. Method 500 proceeds to exit.

In this way, absence or presence of feedback from engine starting devices may be the basis for latent engine starting system diagnostics. Degradation of engine starting systems may be evaluated whether or not engine starting has occurred when commanded.

Thus, method 500 provides for a method for diagnosing operation of an engine starting system, comprising: sampling an engine starting system feedback signal and storing a sampled engine starting system feedback signal to memory via a controller in response to an engine start request and an engine speed being greater than a first threshold speed; ceasing sampling the engine starting system feedback signal via the controller in response to the engine speed being greater than a second threshold speed; and indicating engine starting system degradation in response to the sampled engine starting system feedback signal not conforming to an expected engine starting system feedback signal. The method includes where the engine starting system feedback signal indicates an operating state of a driver circuit. The method includes where the driver circuit provides power to a starter relay. The method includes where the engine starting system feedback signal indicates torque output of an integrated starter/generator. The method includes where an analog to digital converter samples the engine starting system feedback signal. The method further comprises rotating an engine via an electric machine in response to an engine start request. The method further comprises inhibiting automatic engine starting in response to the sampled engine starting system feedback signal not conforming to the expected engine starting system feedback signal.

Method 500 also provides for a method for operating a vehicle, comprising: deactivating a first engine starting system and permitting activation of a second engine starting system in response to feedback of operating status of the first engine starting system and feedback of operating status of the second engine starting system; and deactivating the second engine starting system and permitting activation of the first engine starting system in response to feedback of operating status of the first engine starting system and feedback of operating status of the second engine starting system. The method further comprises inhibiting automatic engine pull-down in response to feedback of operating status of the first engine starting system and feedback of operating status of the second engine starting system. The method further comprises starting an engine via the first engine starting system or the second engine starting system when feedback of operating status of the first engine starting system and feedback of operating status of the second engine starting system do not conform to expected engine starting system feedback signals. The method includes wherein permitting activation of the second engine starting system includes activating the second engine starting system in response to a request to start an engine. The method includes wherein permitting activation of the second engine starting system includes activating the second engine starting system in response to a request to automatically start an engine.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for diagnosing operation of an engine starting system, comprising:

sampling an engine starting system feedback signal and storing a sampled engine starting system feedback signal to memory via a controller in response to an engine start request and an engine speed being greater than a first threshold speed;

ceasing sampling the engine starting system feedback signal via the controller in response to the engine speed being greater than a second threshold speed; and indicating engine starting system degradation in response to the sampled engine starting system feedback signal not conforming to an expected engine starting system feedback signal.

2. The method of claim 1, where the engine starting system feedback signal is output from a transistor driver circuit that selectively opens and closes a starter relay, and where the engine starting system feedback signal indicates an operating state of the transistor driver circuit.

3. The method of claim 2, where the transistor driver circuit provides power to a starter relay.

4. The method of claim 1, where the engine starting system feedback signal indicates torque output of an integrated starter/generator.

5. The method of claim 1, where an analog to digital converter samples the engine starting system feedback signal.

6. The method of claim 1, further comprising rotating an engine via an electric machine in response to an engine start request.

7. The method of claim 1, further comprising inhibiting automatic engine starting in response to the sampled engine starting system feedback signal not conforming to the expected engine starting system feedback signal.

8. A vehicle system, comprising:

an internal combustion engine;

a first engine starting system for the internal combustion engine comprising an electric machine and at least one feedback signal indicating operating status of the first engine starting system; and a controller including executable instructions stored in non-transitory memory that cause the controller to selectively inhibit automatic stopping and starting of the internal combustion engine via a second engine starting system in response to an indication of degradation of the first engine starting system.

9. The vehicle system of claim 8, where the at least one feedback signal is generated via an output of a transistor driver circuit, and where the at least one feedback signal indicates status of a transistor driver circuit.

10. The vehicle system of claim 9, where the transistor driver circuit includes a field effect transistor or a bipolar transistor.

11. The vehicle system of claim 8, where the at least one feedback signal indicates torque output of the first engine starting system.

12. The vehicle system of claim 8, further comprising at least one feedback signal indicating operating status of the second engine starting system, where the at least one feedback signal indicating operating status of the second engine starting system is different from the at least one feedback signal indicating operating status of the first engine starting system.

13. The vehicle system of claim 12, further comprising additional instructions to inhibit operation of the first engine starting system in response to the at least one feedback signal indicating operating status of the first engine starting system.

14. The vehicle system of claim 13, further comprising additional instructions to inhibit operation of the second engine starting system in response to the at least one feedback signal indicating operating status of the second engine starting system.

15. The vehicle system of claim 14, further comprising additional instructions to inhibit automatic stopping of the internal combustion engine in response to the at least one feedback signal indicating operating status of the second engine starting system.

16. A method for operating a vehicle, comprising:

deactivating a first engine starting system that includes a starter that selectively engages a ring gear and permitting activation of a second engine starting system the includes a belt integrated starter/generator in response to feedback of operating status of the first engine starting system and feedback of operating status of the second engine starting system, where feedback of operating status of the first engine starting system includes an output of a transistor driver circuit, and where the transistor driver circuit is in electrical communication with a starter relay; and deactivating the second engine starting system and permitting activation of the first engine starting system in response to feedback of operating status of the first engine starting system and feedback of operating status of the second engine starting system.

17. The method of claim 16, further comprising inhibiting automatic engine pull-down in response to an indication of degradation of the first engine starting system and ambient temperature being less than a threshold temperature.

18. The method of claim 17, further comprising permitting automatic engine pull-down in response to the indication of degradation of the first engine starting system and ambient temperature being greater than the threshold temperature.

19. The method of claim 16, wherein permitting activation of the second engine starting system includes activating the second engine starting system in response to a request to start an engine.

20. The method of claim 16, wherein permitting activation of the second engine starting system includes activating the second engine starting system in response to a request to automatically start an engine.

* * * * *